US012213567B2

(12) United States Patent
Da Rocha Valente et al.

(10) Patent No.: US 12,213,567 B2
(45) Date of Patent: Feb. 4, 2025

(54) JEWELRY ARTICLE COMPRISING A CLASP WITH A SWIVEL LOCK

(71) Applicant: G. et F. Châtelain, succursale de Chanel SARL, La Chaux-de-Fonds (CH)

(72) Inventors: Dany Da Rocha Valente, La Chaux-de-Fonds (CH); Jérôme Nappey, Frambouhans (FR)

(73) Assignee: G. et F. Châtelain, succursale de Chanel SARL, La Chaux-de-Fonds (CH)

( * ) Notice: Subject to any disclaimer, the term of this patent is extended or adjusted under 35 U.S.C. 154(b) by 0 days.

(21) Appl. No.: 18/339,949

(22) Filed: Jun. 22, 2023

(65) Prior Publication Data

US 2024/0000203 A1 Jan. 4, 2024

(30) Foreign Application Priority Data

Jun. 29, 2022 (CH) ..... 787/2022

(51) Int. Cl.
*A44C 5/20* (2006.01)

(52) U.S. Cl.
CPC ..... *A44C 5/2038* (2013.01); *A44C 5/2057* (2013.01)

(58) Field of Classification Search
CPC ... A44C 5/2057; A44C 5/2061; A44C 5/2076; A44C 5/0092; A44C 5/20; A44C 5/2038
See application file for complete search history.

(56) References Cited

U.S. PATENT DOCUMENTS

| | | | | | |
|---|---|---|---|---|---|
| 396,939 | A * | 1/1889 | King | A44C 5/0092 | 24/615 |
| 783,626 | A * | 2/1905 | Eklund | A44C 5/0092 | 63/7 |
| 913,854 | A * | 3/1909 | Seidl | A44C 5/2042 | 24/587.11 |
| 4,184,232 | A * | 1/1980 | Marosy | A44C 5/2061 | 24/DIG. 54 |
| 4,236,283 | A * | 12/1980 | Marosy | A44C 5/2057 | 24/DIG. 53 |

(Continued)

FOREIGN PATENT DOCUMENTS

| | | |
|---|---|---|
| DE | 29510652 U1 | 12/1995 |
| FR | 3098095 A1 | 1/2021 |

(Continued)

*Primary Examiner* — Robert Sandy
*Assistant Examiner* — Louis A Mercado
(74) *Attorney, Agent, or Firm* — BLANK ROME LLP

(57) ABSTRACT

A jewelry article, in particular a bracelet, has two branches and a clasp as a lock pivotally mounted on a pivot integral with or connected to one end of one of the two branches. The lock has a central passage extending along the axis of the pivot and a cavity communicating with the central passage and opening onto one of two lateral sides of the lock. The clasp further includes a connecting member integral with or connected to one end of the other of the two branches and intended to be fitted into the central passage and the cavity of the lock. The connecting member and the cavity are shaped so as to make it possible, on the one hand, to bring the jewelry article between an unlocked and a locked configuration by rotating the lock about the pivot after the connecting member has been fitted into the lock.

14 Claims, 6 Drawing Sheets

(56) References Cited

U.S. PATENT DOCUMENTS

| | | | | | |
|---|---|---|---|---|---|
| 4,364,155 | A * | 12/1982 | Synowicki | ..... | A44C 5/2061 24/574.1 |
| 10,433,621 | B1 * | 10/2019 | Thomsen | ..... | A44C 5/2076 |
| 10,945,494 | B1 * | 3/2021 | Thomsen | ..... | A44C 5/2076 |
| 2016/0058135 | A1 | 3/2016 | Ng | | |

FOREIGN PATENT DOCUMENTS

| | | | |
|---|---|---|---|
| WO | WO-9006068 | A1 * | 6/1990 |
| WO | 2021038395 | A1 | 3/2021 |

* cited by examiner

JEWELRY ARTICLE COMPRISING A CLASP WITH A SWIVEL LOCK

FIELD OF THE INVENTION

The present invention relates to a jewelry article, in particular a bracelet comprising a clasp with a swivel lock that is almost hidden when the jewelry article is worn.

BACKGROUND ART

There already exist bracelets, comprising a closing or fastening mechanism comprising a lock arranged to swivel around a pivot to bring the bracelet from a locked configuration, whereby two branches of the bracelet are connected to each other, to an unlocked configuration, whereby the two branches of the bracelet are disconnected.

By way of example, FR3098095 discloses a clasp, in particular for bracelet, which is capable of having a locked position and at least one unlocked position. This clasp comprises two end pieces, each of which is capable of being connected to an end of the bracelet or forming part of such an end, as well as a lock which, for assembling the clasp in the locked position, is arranged between the two end pieces and assembled with them in a longitudinal arrangement. The lock is rotatable relative to the two end pieces about the longitudinal arrangement, in order to move the clasp from the locked position to the unlocked position.

US2016058135 discloses another example of a clasp for jewelry, comprising a male connector, a female connector, a locking sleeve, and locking cylinders. The locking cylinders are arranged on the outer ends of both the male connector and the female connector. The male and female connectors are fitted into either ends of the locking sleeve. By rotating the locking sleeve, the male connector can be reliably and securely locked and mated with the female connector.

These clasps have the disadvantage of having a large number of parts and are difficult to design.

It is therefore an object of the present invention to provide a jewelry article comprising a clasp of simplified design.

Another object of the invention is to provide a jewelry article comprising a clasp that is simple to manipulate.

An additional object of the invention is to provide a jewelry article comprising a clasp that is hardly visible, or even almost imperceptible, when worn.

BRIEF SUMMARY OF THE INVENTION

These objects are achieved by a jewelry article, in particular a bracelet, comprising two curved branches and a clasp comprising a lock swivably mounted on a pivot connected to one end of one of the two curved branches. The lock comprises a central passage extending along the axis of the pivot as well as a cavity communicating with the central passage and opening on one of the two lateral sides of the lock. The clasp further comprises a connecting member connected to one end of the other of the two curved branches and intended to be fitted into the central passage and the cavity of the lock. The connecting member and the cavity are shaped to allow the jewelry article to be moved from an unlocked configuration to a locked configuration by rotation of the lock about the pivot in one direction after the connecting member is fitted into the lock. Rotation of the lock about the pivot in an opposite direction allows the jewelry article to be moved from the locked configuration to the unlocked configuration for removal of the connecting member from the lock.

In an embodiment, the lock includes a wall extending toward a longitudinal side of the lock. Rotation of the lock into the locked configuration brings a portion of the connecting member against the wall to prevent removal of the connecting member.

In an embodiment, the connecting member comprises a substantially cylindrically shaped guiding element for fitting into the central passage of the lock and a protuberance arranged adjacent to the guiding element and intended to abut against the wall.

In an embodiment, the clasp comprises a clipping system to clip the lock into two indexed angular positions. One of the two indexed angular positions corresponds to the angular position of the lock when the jewelry article is in the locked configuration. The other of the two indexed angular positions corresponds to the angular position of the lock when the jewelry article is in the unlocked configuration for removal and insertion of the connecting member.

In an embodiment, the clipping system comprises a pin mounted on a resilient member. The pin and the resilient member are arranged in a socket on the end of the curved branch having the pivot. The end of the pin projects into a curved groove arranged on the adjacent lateral side of the lock. A cavity is present at both ends of the curved groove to receive the end of the pin under the action of the resilient member in order to clip the lock into either of the two angular positions.

In an embodiment, the end of one branch of the bracelet comprises a curved groove arranged to receive a stop connected to the lock so that the stop blocks the rotation of the lock around the pivot when the pin is in either of the two cavities. This prevents a shearing effect on the pin of the clipping system when stresses are exerted on the lock during the passage from the locked configuration to the unlocked configuration and vice versa.

In an embodiment, the curved groove of the lock and the curved groove of the branch are substantially diametrically opposed when the jewelry article is in the unlocked configuration.

In an embodiment, the lock has a substantially identical appearance to the two curved branches when the jewelry article is worn.

In an embodiment, the end of each curved branch has a planar surface arranged against a planar surface of respectively one and the other of two opposite lateral sides of the lock.

In an embodiment, the guiding element has a longitudinal slot separating the guiding element into two parts so that the walls of the central passage of the lock can apply a force to said parts tending to move them toward each other to ensure proper holding of the guiding element.

In an embodiment, the central passage comprises a first cylindrical portion having a first diameter and a second portion having a second diameter smaller than the first diameter. The pivot is a screw arranged in the central passage and screwed into the end of the corresponding curved branch.

In an embodiment, the lock is an integral part.

In an embodiment, the pivoting axis of the lock is offset from the axis of inertia of the lock.

In an embodiment, the two curved branches are connected to each other by a hinge.

In a preferred embodiment, the jewelry article is in the form of a bracelet.

BRIEF DESCRIPTION OF THE FIGURES

Examples of implementation of the invention are described in the description illustrated by the attached figures in which.

EXAMPLES OF EMBODIMENTS OF THE INVENTION

Figure 1:
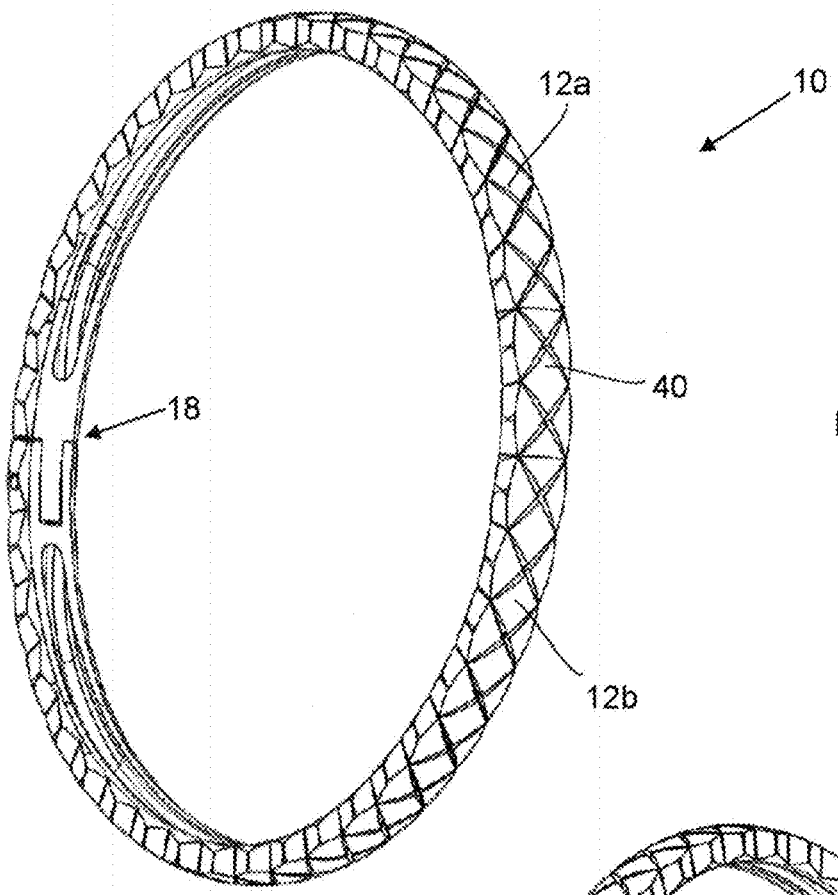
FIG. 1 shows a perspective view of a bracelet having two branches and a clasp comprising a lock arranged between one end of each branch and being in a locked configuration, according to an embodiment.
Figure 2:
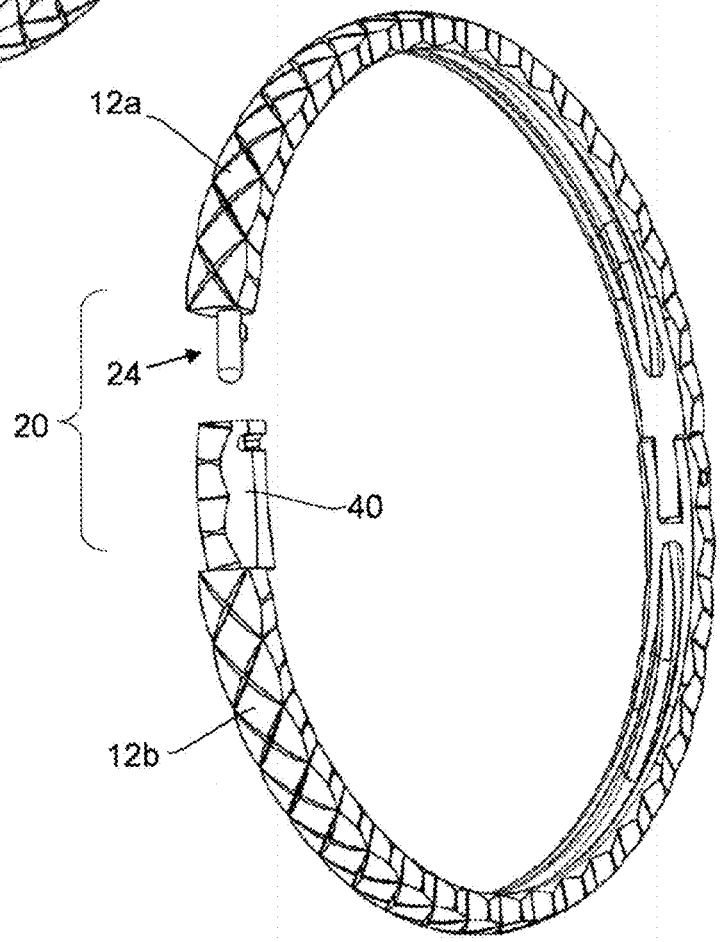
FIG. 2 shows a view similar to FIG. 1 when the bracelet clasp is open.

In the present application, the jewelry article is notably a bracelet 10 as illustrated in particular by FIGS. 1 and 2. The bracelet 10 comprises a first and a second branch 12*a*, 12*b* which may be, for example, rigid and curved in order to properly fit the contour of the wrist. One of the ends of each branch 12*a*, 12*b* of the bracelet can be connected by a hinge 18. According to a non-illustrated embodiment, the hinge may be replaced by a flexible blade arranged in a recess located on an inner surface of the two branches as disclosed in publication WO2021038395.

Figure 3:
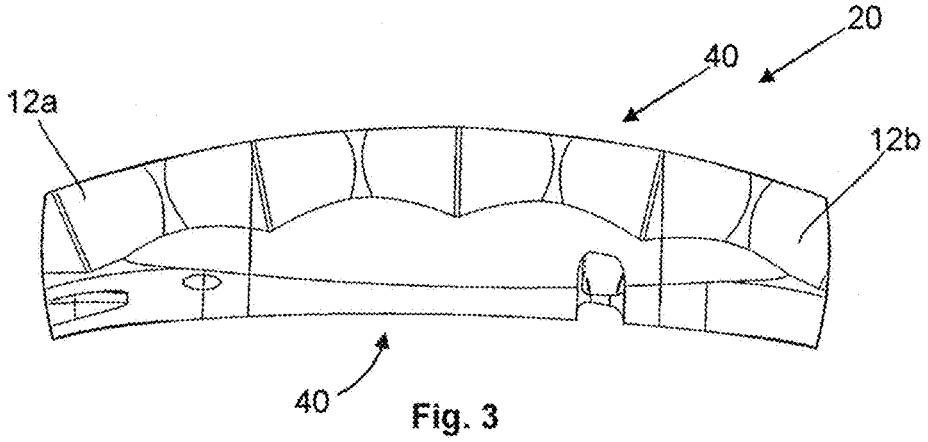
FIG. 3 shows a perspective view of the clasp of FIG. 1 comprising the lock cooperating with the respective ends of the two branches.

The other end of each curved branch 12*a*, 12*b* of the bracelet is shaped to cooperate with a lock 40 of a clasp 20, as illustrated in particular in FIG. 3. The two opposite lateral sides 42*a*, 42*b* rest against the respective ends 13*a*, 13*b* of the two branches of the bracelet 10, as can be seen in particular in FIGS. 7 and 8. The shape of the lock 40 and of the ends of the two branches 12*a*, 12*b* are such that the lock 40 illustrated notably in FIGS. 1 and 3 is almost imperceptible, or at least hardly visible when the bracelet 10 is worn.

In other words, the appearance and outer shell of the lock 40 ensures a seamless transition between the first and second curved branches 12*a*, 12*b* of the bracelet 10 and the lock 40 both in shape and appearance making the lock 40 difficult to distinguish from the two branches of the bracelet 10.

In an advantageous embodiment not shown, the top surface of the two curved branches as well as the top surface of the lock may include patterns. The patterns may be chosen so that the two interfaces between the two lateral sides 42*a*, 42*b* of the lock 40 and the respective ends 13*a*, 13*b* of the two branches blend with the patterns. For example, the patterns may include a series of subtly oriented chisels so that the two interfaces can be mistaken for two chisels that blend with the other chisels making the clasp lock imperceptible when the bracelet is worn.

Figure 5:
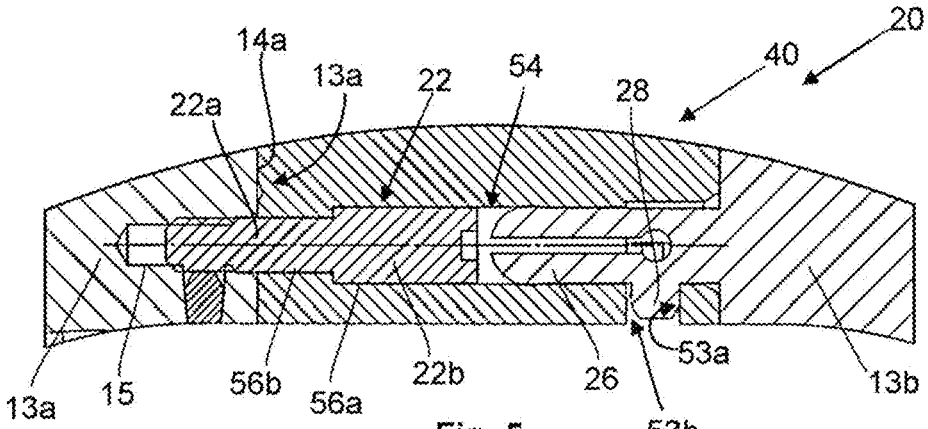
FIG. 5 shows a longitudinal cross-sectional view of the clasp of FIG. 3 at the level of the pivot axis of the lock.
Figure 6:
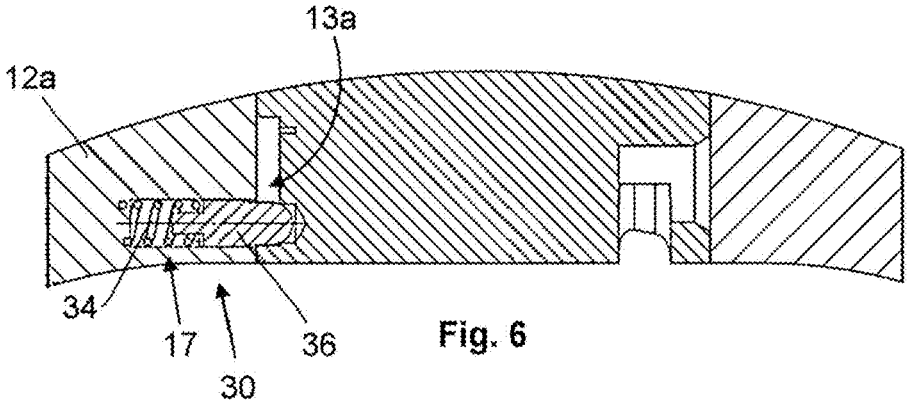
FIG. 6 shows a longitudinal cross-sectional view of the clasp of FIG. 3 at the level of a clipping system.

With reference to FIG. 5, the lock 40 of the clasp 20 is pivotally mounted about a pivot 22 connected to one end 13*a* of the first branch of the bracelet. The pivot 22 is preferably in the form of a screw that is screwed into a threaded-hole 15 opening onto a flat surface 14*a* of the end 13*a* of the first branch. The lock 40 includes a central passage 54 extending along the axis of the pivot 22 as well as a cavity 58 (FIG. 11), the specific shape of which will be described in detail later. The cavity 58 is arranged to communicate with the central passage 54 and opening at one of two opposite lateral sides 42*a*, 42*b* of the lock 40.

Figure 13:
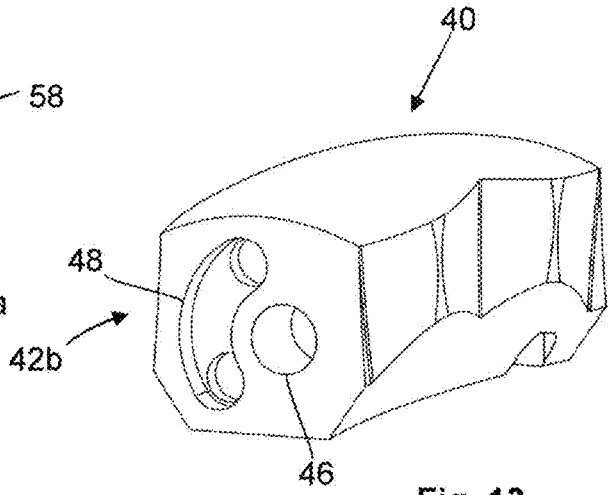
FIG. 13 shows a perspective view of the lock where the other side of the lock is visible.
Figure 14:
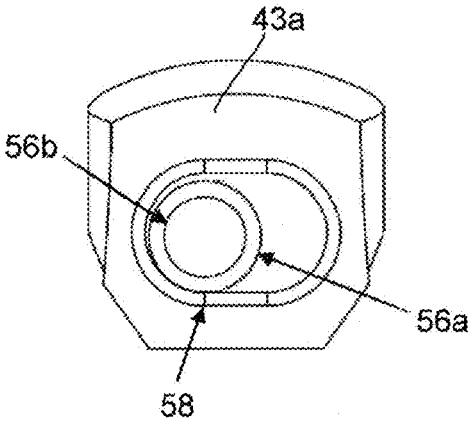
FIG. 14 shows a front view of the lateral side of the lock visible in FIG. 12.
Figure 15:
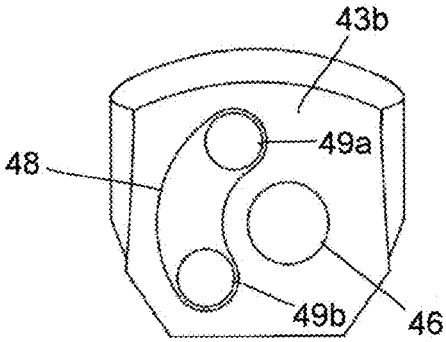
FIG. 15 shows a front view of the lateral side of the lock visible in FIG. 13.

The central passage 54 comprises first and second cylindrical portions 56*a*, 56*b*. The first cylindrical portion 56*a* extends along a major portion of the length of the lock 40. The second cylindrical portion 56*b* is smaller in diameter than the diameter of the first cylindrical portion 56*a* and extends to central opening 46 arranged on the other of two lateral sides 42*a*, 42*b* of the lock 40 as shown in FIG. 13.

As illustrated in FIG. 5, the lock 40 is secured to the end 13*a* of the first branch 12*a* by the insertion of the screw 22 into the central passage 54 so that the screw body 22*a* is screwed into the threaded hole 15. The difference in diameter between the first and second cylindrical portions 56*a*, 56*b* defines a shoulder against which the screw head 22*b* rests to ensure that the lock 40 is held against the end 13*a* of the first branch.

Figure 11:
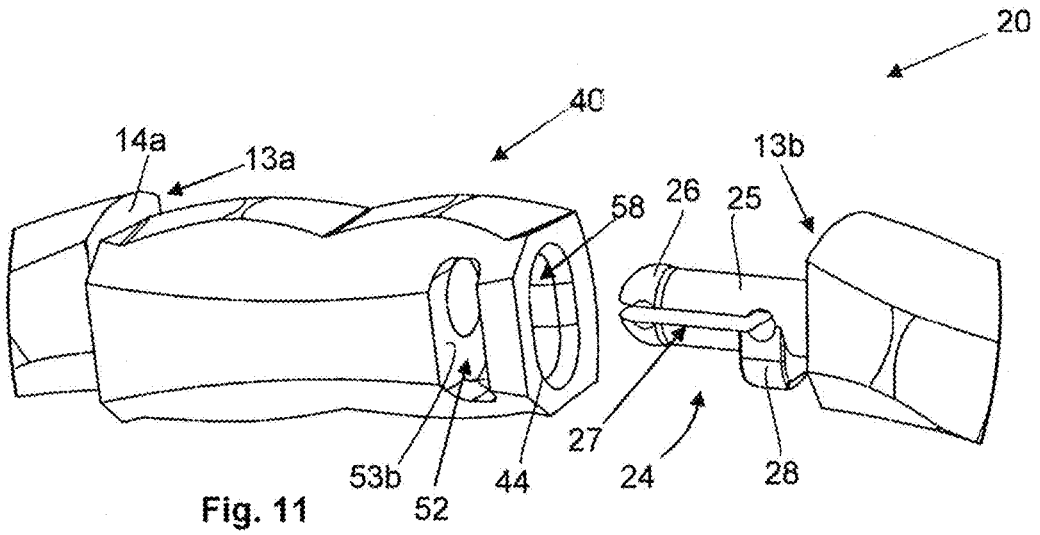
FIG. 11 shows a perspective view of the clasp when the connecting member attached to the end of one of the two branches is disengaged from the lock.
Figure 12:
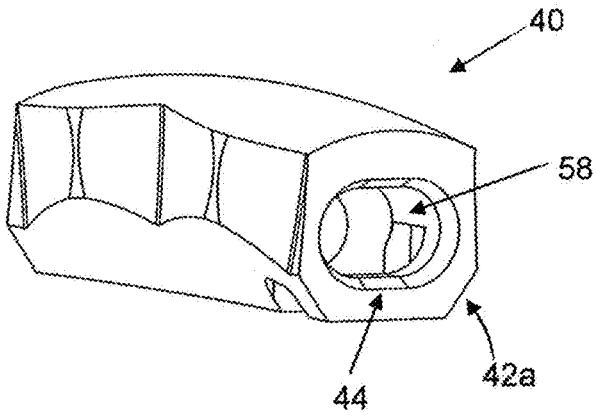
FIG. 12 shows a perspective view of the lock where one of the lateral sides of the lock is visible.

With reference in particular to FIG. 11, the clasp 20 further comprises a connecting member 24 connected to or forming a single piece with an end 13*b* of the second branch of the bracelet. The connecting member 24 is intended to be inserted into the central passage 54 and the cavity 58 of the lock according to FIG. 5.

The connecting member 24 and the cavity 58 are shaped, as described in more detail hereafter, so that the bracelet can be moved from an unlocked configuration to a locked configuration by rotating the lock 40 about the pivot 22 in one direction after insertion of the connecting member 24 into the lock. When the bracelet is in the locked configuration, it is only necessary to rotate the lock 40 about the pivot in a opposite direction in order to remove the connecting member 24 from the lock 40.

As illustrated notably in FIGS. 6, 10, 13 and 15, the clasp further comprises a clipping system 30 to clip the lock 40 in two indexed angular positions. The first indexed angular position corresponds to the angular position of the lock 40 around the pivot 22 when the bracelet is in the locked configuration. The second indexed angular position corresponds to the angular position of the lock 40 around the pivot 22 in order to allow the introduction of the connecting member 24 into the central passage 54 of the lock 40 to lock the bracelet and to allow the removal of the connecting member 24 from the lock 40.

To this end, the clipping system 30 comprises a pin 36 mounted on an elastic member 34. The pin and the elastic member are arranged in a blind hole 17 located at the end 13*a* of the first branch 12*a* of the bracelet. The end of the pin 36 protrudes into a curved groove 48 arranged on a lateral side 42*b* of the lock 40, illustrated in FIGS. 13 and 15.

A substantially semi-spherical shaped cavity 49*a*, 49*b* is present at the ends of the curved groove 48 to receive the end of the pin 36 under the action of the elastic member, such as a compression spring 34, to clip the lock 40 into either of the two angular positions. The end of the pin 36 thus moves along the groove 48 as the lock is rotating from one of its two indexed angular positions to the other.

Referring in particular to FIG. 11, the connecting member 24 comprises a guiding element 25, which comprises a substantially cylindrical portion and a distal part 26 of slightly larger diameter than the cylindrical portion and the diameter of the central passage 54 of the lock 40. The guiding element 25 further comprises a longitudinal slot 27 separating the cylindrical portion and the distal part into two distinct portions whose cross-section is substantially semi-cylindrical in shape.

The longitudinal slot 27 provides the guiding element 25 with elastic properties so that the walls of the central passage 54 of the lock 40 apply a force to the two separate portions of the distal part 26 tending to move them toward each other to ensure a secure fit of the guiding element 25 in the central passage of the lock as shown in FIG. 5.

Figure 7:
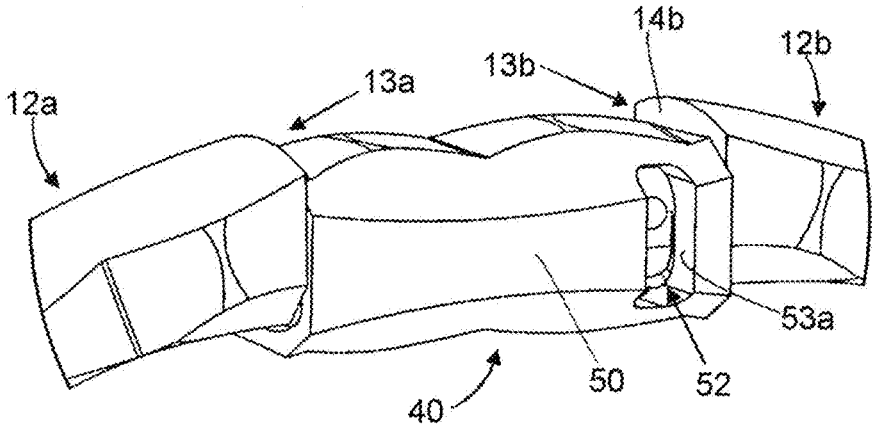
FIG. 7 shows a perspective view of the clasp when the lock is in an unlocked configuration.

According to FIG. 11, the connecting member 24 further includes a protuberance 28 arranged next to and at a proximal part of the guiding element 25. The angular orientation of the lock 40 about its pivot 22 allows this protuberance, which is partially oblong in this example, to engage with the lock. To this end, the cavity 58 communicates with an orifice 44 located on the lateral side 42*a* of the lock which faces the connecting member 24. With reference in particular to FIGS. 7 and 11, the cavity 58 further communicates with an opening 52 located on a longitudinal side 50 of the lock. The opening 52 is defined in particular by a first and a second wall 53*a*, 53*b* which extend towards the external surface of the longitudinal side of the lock in a direction orthogonal to the pivot axis of the lock.

Figure 9:
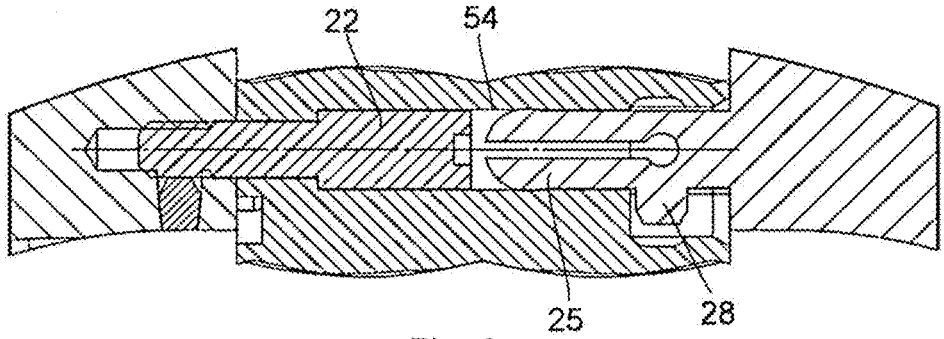
FIG. 9 shows a longitudinal cross-sectional view of the clasp of FIG. 7 at the level of the axis of rotation of the lock.
Figure 10:
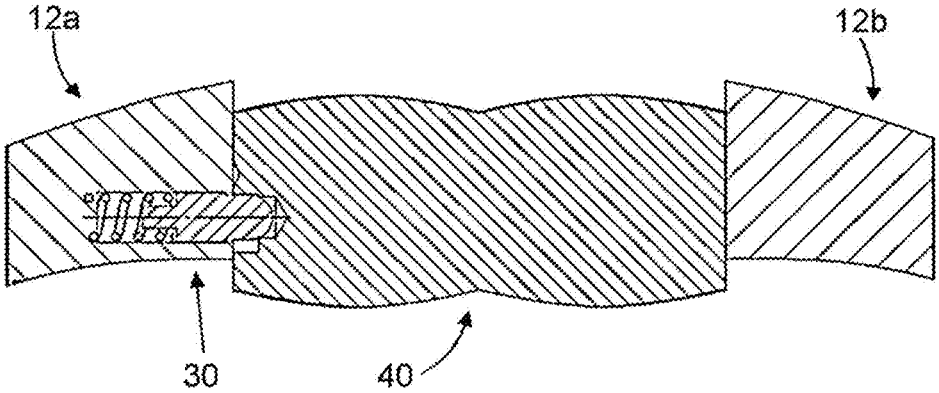
FIG. 10 shows a longitudinal cross-sectional view of the clasp of FIG. 7 at the level of the clipping system.

When the bracelet clasp 20 is brought to an unlocked configuration, i.e., when the lock 40 is pivoted about its pivot in the indexed angular position allowing the insertion or removal of the connecting member 24, as illustrated in particular by FIGS. 9 and 11, the protuberance 28 as well as the guiding element 25 can be introduced into the cavity 58 through the oblong opening 44 in order to fit the guiding element 25 into the central passage 54 of the lock.

Figure 4:
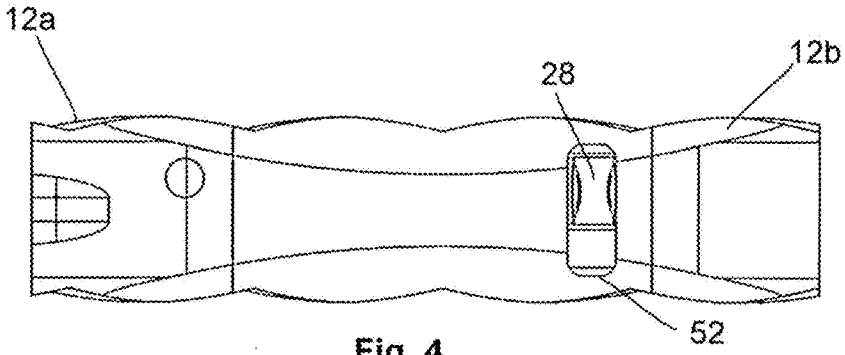
FIG. 4 shows a bottom view of the clasp in FIG. 3.

In order to lock the clasp 20, the lock 40 is pivoted about its pivot to the other indexed angular position. In this position the protuberance 28 of the connecting member 24 is in the opening 52 between the first and second walls 53*a*, 53*b* as illustrated in particular by FIGS. 3 to 5. The protuberance 28 of the connecting member 24 is thus facing the first wall 53*a* (FIG. 5), which acts as a stop preventing the opening of the clasp 20 of the bracelet.

To unlock the clasp, it is sufficient to rotate the lock 40 about its pivot in the opposite direction to bring the lock back to the other indexed angular position in order to remove the wall 53*a* from the protuberance so that the connecting member of the lock can be removed.

Figure 8:
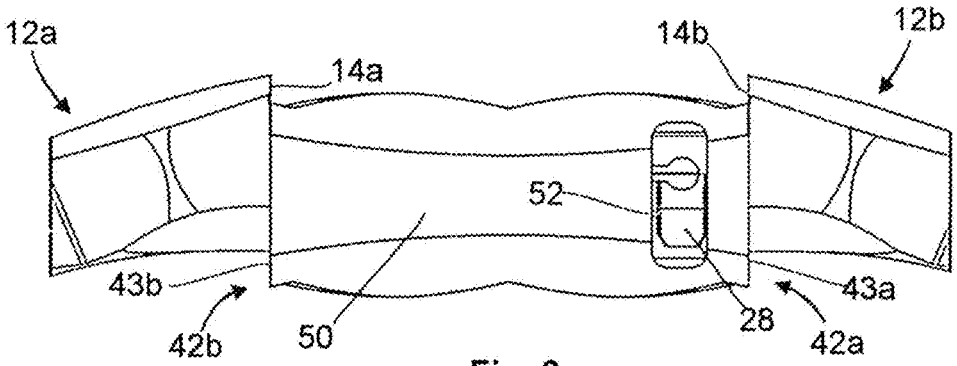
FIG. 8 shows a side view of the clasp of FIG. 7.

With reference to FIGS. 8 and 9, the end 13*a*, 13*b* of each branch 12*a*, 12*b* of the bracelet has a flat surface 14*a*, 14*b* arranged against a flat surface 43*a*, 43*b* of respective opposite lateral sides 42*a*, 42*b* of the lock 40 that slide over each other when the lock is pivoted from one of its two indexed angular positions to the other.

It should be noted that according to this clasp, the pivot axis of the lock is offset from the axis of inertia of the lock. The latter is a one-piece part which has the advantage of simplifying the manufacture of the clasp and reducing its production cost.

Figure 16:
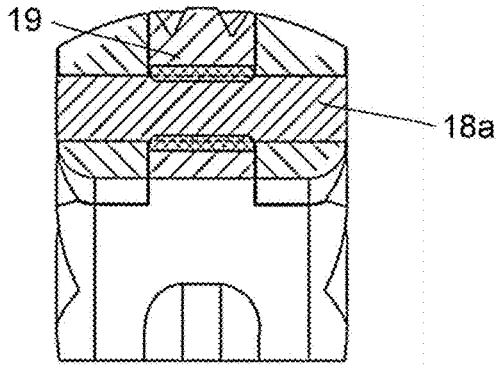
FIG. 16 shows a cross-sectional view at the level of the hinge connecting the two branches of the bracelet according to an embodiment.
Figure 17:
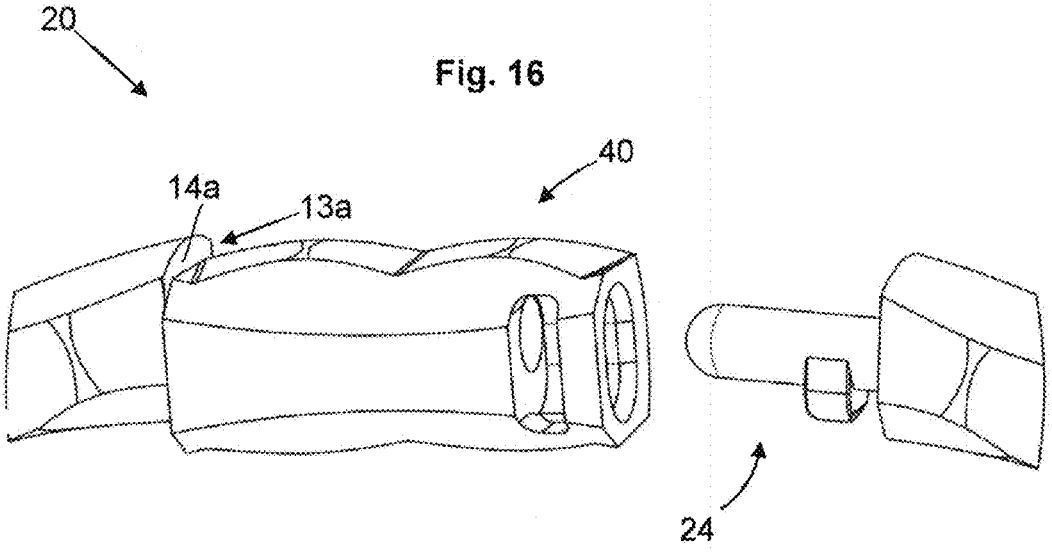
FIG. 17 shows a view similar to the clasp of FIG. 11 according to another embodiment.
Figure 18:
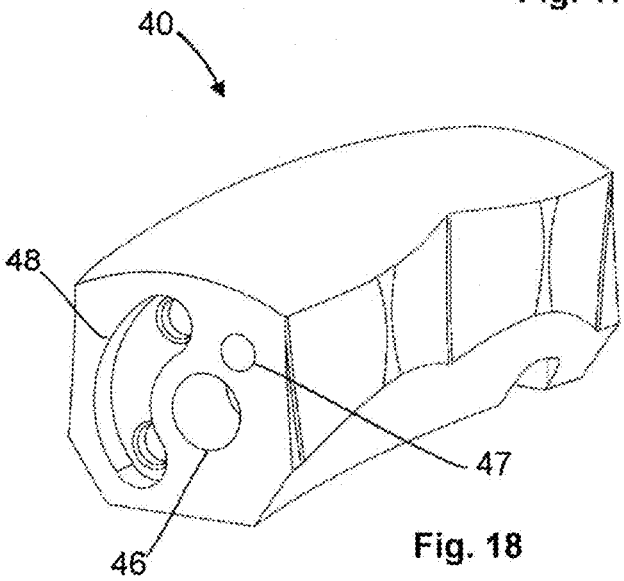
FIG. 18 shows a perspective view of the lock of the clasp of FIG. 17 where one of the lateral sides of the lock is visible.
Figure 19:
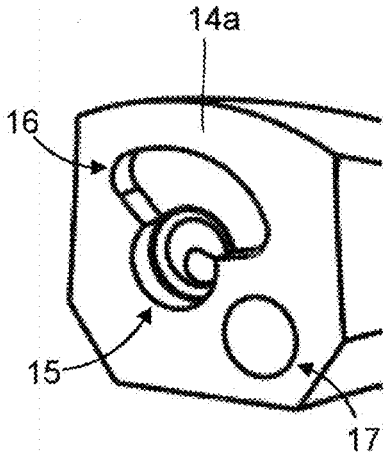
FIG. 19 shows a perspective view of one end of a branch of the bracelet designed to cooperate with the lock of the clasp of FIG. 17.

With reference to FIG. 16, the bracelet may include a friction ring 19 mounted on the stem 18*a* at the hinge to dampen the movement of the two branches upon opening and closing the bracelet. In this case, the connecting member 24 may be devoid of a longitudinal slot as shown in FIG. 17.

According to another embodiment illustrated by FIGS. 17 to 22, the end 13*a* of a branch 12*a* comprises a curved groove 16 arranged around the threaded hole 15 intended to receive the screw body for fixing the lock 40. The latter comprises on its side 42*b* a bind hole 47 into which a stop 47*a* (FIG. 20) is fixed, for example in the form of a pin driven into the bind hole.

Figure 20:
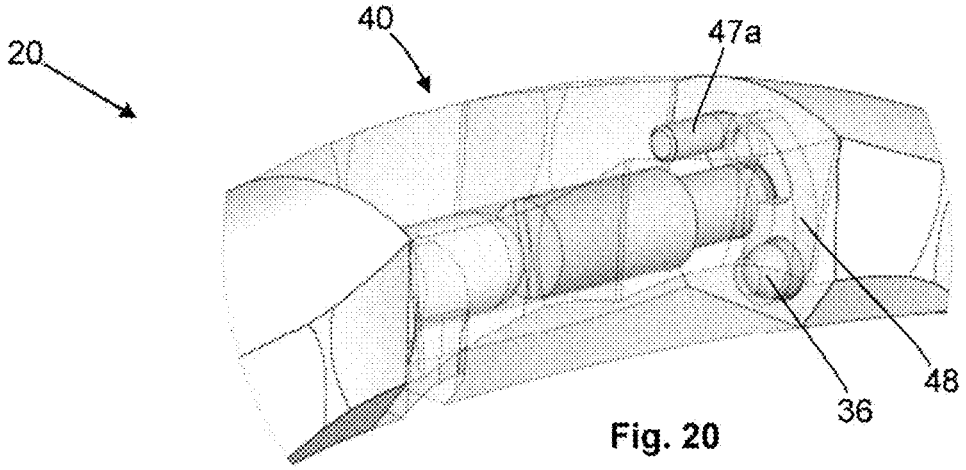
FIG. 20 shows a transparent perspective view of the clasp of FIG. 17 in a locked configuration.
Figure 21:
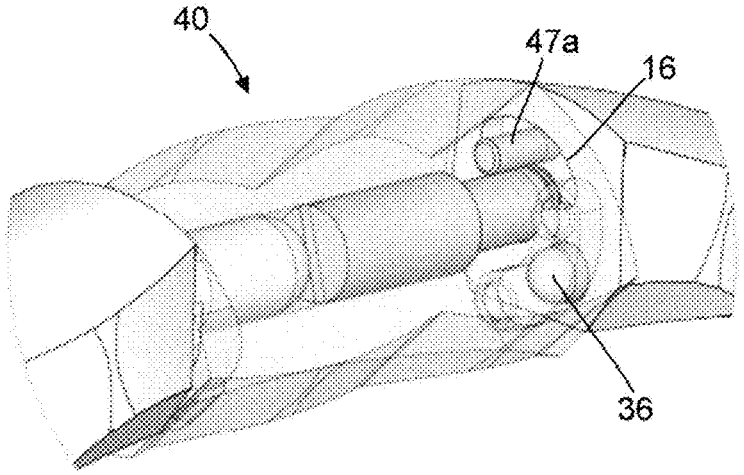
FIG. 21 shows a view similar to FIG. 20 when the clasp is in a locked configuration.
Figure 22:
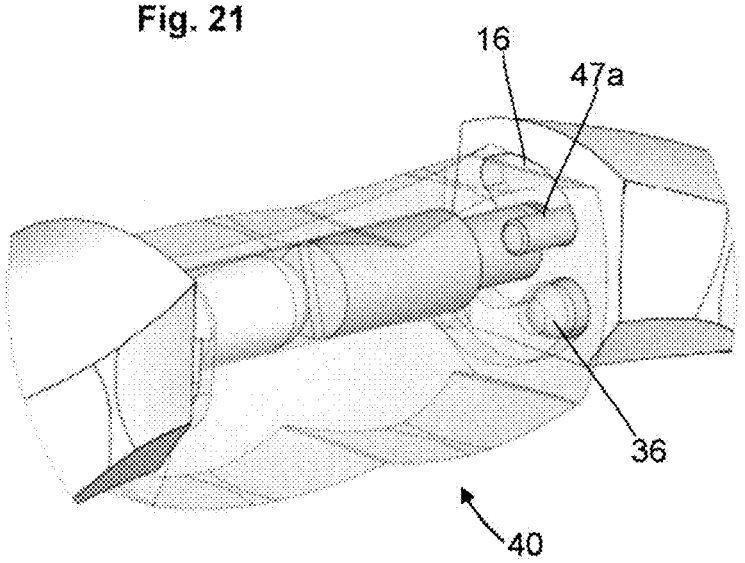
FIG. 22 shows a view similar to FIG. 21 when the lock of the clasp is halfway between the locked and unlocked configurations.

According to FIGS. 20-22, the free end of the pin 47*a* is arranged in the curved groove 16 present on the end of the branch. When the clasp 20 is in a locked configuration, the pin 47*a* abuts an edge of the groove 16. This pin 47*a* moves along the curved groove 16 and abuts the opposite edge of the groove 16 when the clasp 20 is moved from the locked configuration to the unlocked configuration. This prevents shearing of the pin 36 of the clipping system when stresses are placed on the lock 40 as it is moved from the locked configuration to the unlocked configuration and vice versa.

The curved groove 48 of the lock 40 and the curved groove 16 of the branch 12*a* are preferably substantially diametrically opposed when the bracelet is in the unlocked configuration as shown in FIG. 22.

Various modifications can of course be made to the jewelry article without deviating from the invention as defined in the appended claims. For instance, the shape of protuberance of the connecting member as well as the configuration of the cavity of the lock can vary to ensure on the one hand, a locking of the connecting member in one of the two indexed angular positions of the lock and, on the other hand, an unlocking of the connecting member in the other of the two indexed angular positions of the lock to allow the removal of the connecting member from the lock.

For example, in order to completely conceal the locking mechanism, the cavity 58 may include a groove defining the first and second walls 53*a*, 53*b* instead of the opening 52 present on one of the longitudinal sides of the lock 40.

Furthermore, although the above description refers to a bracelet, the jewelry article may as well be a necklace.

Reference list

- Jewelry article 10
  - First and second branches 12a, 12b
    - End 13a, 13b
      - Flat surface 14a, 14b
      - threaded-hole 15
      - Curved groove 16
      - Blind hole 17
  - Hinge 18
    - Stem 18a
    - Ring 19
  - Clasp 20
    - Pivot 22
      - Screw
        - Screw body 22a
        - Screw head 22b
    - Connecting member 24
      - Guiding element 25
        - Distal part 26
        - Longitudinal slot 27
      - Protuberance 28
    - Clipping system 30
      - Elastic member 34
      - Pin 36
    - Lock 40
      - First lateral side 42a
        - Flat surface 43a
        - Orifice 44
      - Second lateral side 42b
        - Flat surface 43b
        - Central opening 46
        - Blind hole 47
        - Stop 47a (e.g. pin)
        - Curved groove 48
          - Semi-spherical shaped cavity 49a, 49b
      - Longitudinal side 50
        - Opening 52
          - First and second walls 53a, 53b
        - Central passage 54
          - First and second cylindrical portions 56a, 56b
      - Cavity 58

The invention claimed is:

1. A jewelry article, in particular a bracelet, comprising two branches and a clasp comprising a lock pivotally mounted on a pivot integral with or rigidly connected to one end of one of the two branches, wherein the lock comprises a central passage extending along an axis of the pivot such that the pivot is arranged inside said central passage and a cavity communicating with the central passage and opening onto one of two lateral sides of the lock, the clasp further comprising a connecting member integral with or connected to one end of the other of the two branches and intended to be fitted into the central passage and the cavity of the lock, the connecting member and the cavity being shaped so as to make it possible, on one hand, to bring the jewelry article from an unlocked configuration to a locked configuration by rotating the lock about the pivot in one direction after the connecting member has been fitted into the lock and, on the other hand, to bring the jewelry article from the locked configuration to the unlocked configuration by rotating the lock about the pivot in an opposite direction so that the connecting member can be removed from the lock.

2. The jewelry article of claim 1, wherein the lock comprises a wall extending toward a longitudinal side of the lock, and wherein rotation of the lock into the locked configuration brings a part of the connecting member against said wall to prevent removal of the connecting member.

3. The jewelry article of claim 2, wherein the connecting member comprises a guiding element of cylindrical shape intended to be fitted into the central passage of the lock and a protuberance arranged next to the guiding element and intended to abut against said wall.

4. The jewelry article of claim 3, wherein the guiding element comprises a longitudinal slot separating the guiding element into two parts so that those walls of the central passage of the lock exert a force on said parts tending to bring them closer to each other to ensure retention of the guiding element.

5. The jewelry article of claim 1, wherein the clasp further comprises a clipping system to clip the lock in two indexed angular positions corresponding to the angular position of the lock around the pivot when the jewelry article is respectively in the locked configuration and in the unlocked configuration to allow removal and insertion of the connecting member.

6. The jewelry article of claim 5, wherein the clipping system comprises a pin mounted on an elastic member, which are arranged in a hole located at the end of the branch comprising the pivot, a free end of the pin projecting into a curved groove arranged on the adjacent lateral side of the lock, a cavity being present at both ends of the curved groove in order to receive the free end of the pin under an action of the elastic member so as to clip the lock into either of said two indexed angular positions.

7. The jewelry article of claim 6, wherein the end of the branch comprises a curved groove arranged to receive a stop secured to the lock so that the stop blocks rotation of the lock about the pivot when the pin is in either of the two cavities.

8. The jewelry article of claim 7, wherein the curved groove of the lock and the curved groove of the branch are diametrically opposed when the jewelry article is in the unlocked configuration.

9. The jewelry article of claim 1, wherein the lock has an identical appearance to both branches when the jewelry article is worn.

10. The jewelry article of claim 1, wherein the end of each branch has a flat surface arranged to slide against a flat surface of respective opposite the two lateral sides of the lock when the lock is rotated about the pivot.

11. The jewelry article of claim 1, wherein the central passage comprises a first cylindrical portion of a first diameter and a second cylindrical portion of a second diameter smaller than the first diameter, and wherein the pivot is a screw arranged in the central passage and screwed into a threaded hole at the end of the corresponding branch.

12. The jewelry article of claim 1, wherein the lock is a single piece.

13. The jewelry article of claim 1, wherein the two branches are connected to each other by a hinge.

14. The jewelry article of claim 1, in a form of a bracelet.

* * * * *